United States Patent [19]

Eriksson

[11] 4,171,850

[45] Oct. 23, 1979

[54] METHOD OF AND MACHINE FOR MANUFACTURING PIPE CLEANERS

[75] Inventor: Allan Eriksson, Vetlanda, Sweden

[73] Assignee: Rune Jansohn, Nassjo, Sweden; a part interest

[21] Appl. No.: 864,513

[22] Filed: Dec. 27, 1977

[51] Int. Cl.[2] ..... A46D 3/05

[52] U.S. Cl. ..... 300/2; 300/21; 29/417; 29/33 F; 29/780; 57/6

[58] Field of Search ..... 29/417, 779, 780, 788, 29/819, 564.1, 564.3, 564.6, 33 F; 300/21, 2, 1; 57/156, 6, 34 R; 140/149

[56] References Cited

U.S. PATENT DOCUMENTS

| | | | |
|---|---|---|---|
| 1,004,643 | 10/1911 | Gilson | 29/780 |
| 2,188,906 | 2/1940 | Lackey | 29/33 F |
| 2,267,850 | 12/1941 | Ushakoff | 300/21 |
| 2,449,668 | 9/1948 | Peterson | 300/2 |
| 2,464,860 | 3/1949 | Green | 140/149 |
| 2,707,297 | 5/1955 | Woodling | 300/21 |
| 3,140,122 | 7/1964 | Spiegel | 300/2 |
| 3,254,923 | 6/1966 | Marks et al. | 140/149 |
| 3,665,577 | 5/1972 | Dieffenbach | 29/564.6 |

*Primary Examiner*—Francis S. Husar
*Assistant Examiner*—Daniel C. Crane
*Attorney, Agent, or Firm*—Hubbell, Cohen, Stiefel & Gross

[57] ABSTRACT

Pipe cleaners comprising a plurality of short pieces of threads as active elements are formed in machines arranged in pairs. Threads are wound in helices around two rigid wires, which are advanced adjacent and parallel to each other and each belong to a different one of the machines of the pair. The turns of the helices are severed between the wires in such a way that two pieces of thread are formed of each turn. Half of the thread pieces are secured to each wire by approaching one additional wire to each of the firstmentioned wires and twisting the wires pairwise for clamping the thread pieces between the wires of each pair and for forming two pipe cleaner strings, which are subsequently cut into individual pipe cleaners.

The common parts of the machines of a pair comprise thread bobbins, thread winding means, thread severing means and means for guiding the thread helices forming wires.

19 Claims, 5 Drawing Figures

METHOD OF AND MACHINE FOR MANUFACTURING PIPE CLEANERS

FIELD OF THE INVENTION

The invention relates to a method of manufacturing pipe cleaners and a machine for the manufacture thereof. The pipe cleaners in question which may be slightly conical in shape comprise short transverse pieces of threads which are firmly clamped between two rigid wires which are twisted together in helices for performing their clamping action.

SUMMARY OF THE INVENTION

In the method according to the invention a soft thread, e.g. of cotton is wound helically around one of the two rigid wires in loops having a circumferential length which is much longer than the circumference of the wire. The second rigid wire is approached to the helix thus formed and the turns of the thread are severed so that the thread is divided into short pieces. These pieces are clamped between the rigid wires which are advanced together while being tensioned, so that the pieces of thread are held between them. At a certain point on the common path of the wires twisting of them commences to improve their clamping of the threads. In the preferred embodiment of the invention a considerable acute angle between the threads if formed at this point by conducting one of the wires in a loop away from and back to the other wire. The pipe cleaner string thus formed is subsequently cut into individual pipe cleaners.

The machine for the manufacture of the pipe cleaners comprises a rotatable spool for each of said two wires, at least one rotatable bobbin for said thread to be cut into pieces, means for winding the thread into said loops around one of the wires, a knife for severing the thread loops, means for advancing the two wires under tension and for twisting them together to hereby clamp the thread pieces between the wires, and means for cutting the pipe cleaner string thus formed into individual pipe cleaners. A particular feature of the machine according to the invention resides in new means for guiding one of the wires upstream of and in the thread winding area.

DESCRIPTION OF THE PREFERRED EMBODIMENT

Figures 1, 2:
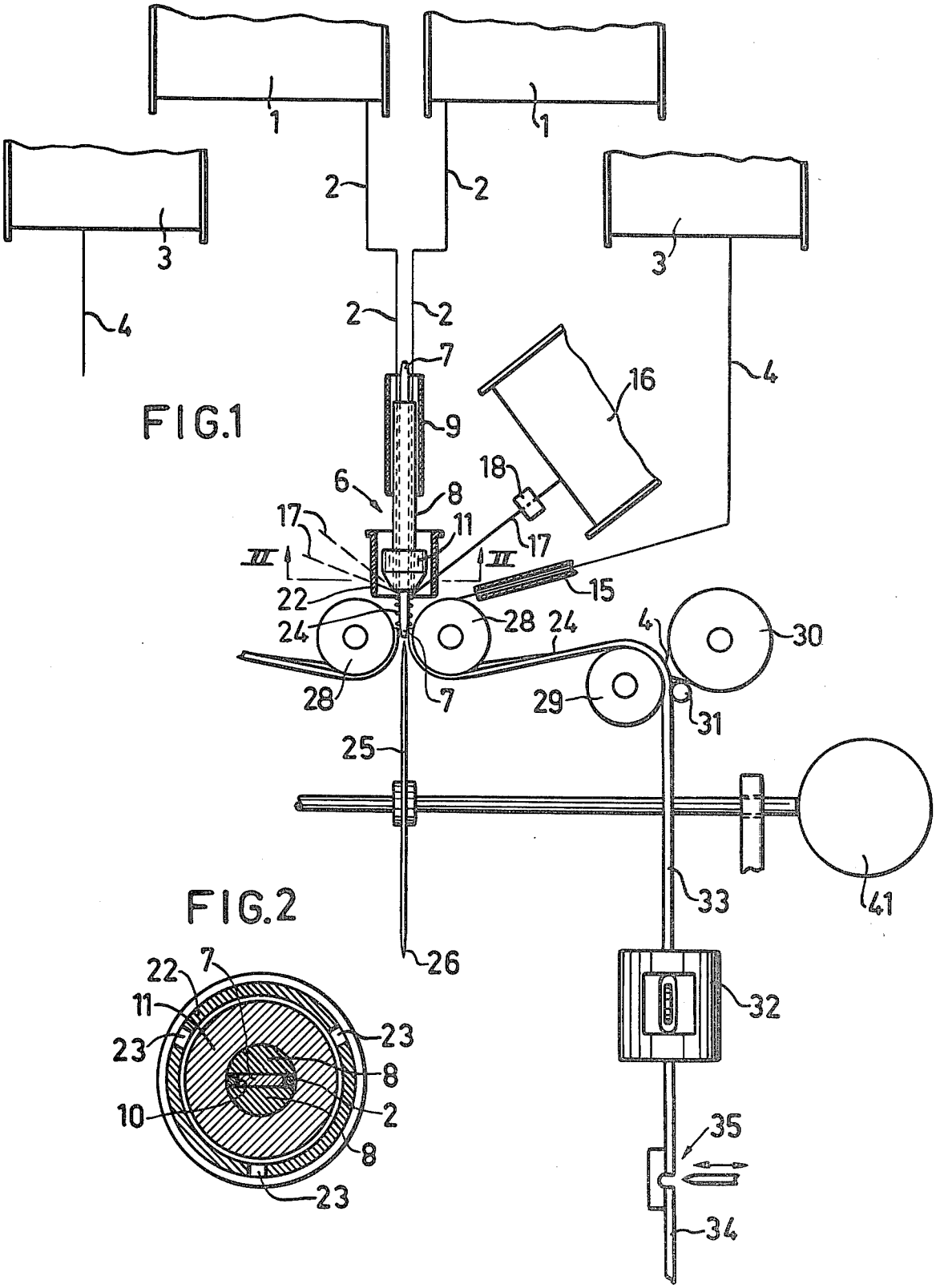
FIG. 1 is a very simplified plan view of a pipe cleaner forming machine which is comprised in a pair of such machines, a small portion of the other machine of the pair being also shown.
FIG. 2 is a transverse section along line II—II of FIG. 1 on a larger scale.

Two machines according to the invention are combined into a pair. Since the machines are similar, only those parts which the two machines have in common and the remaining principal parts of one machine have been shown in the drawings.

Figure 3:
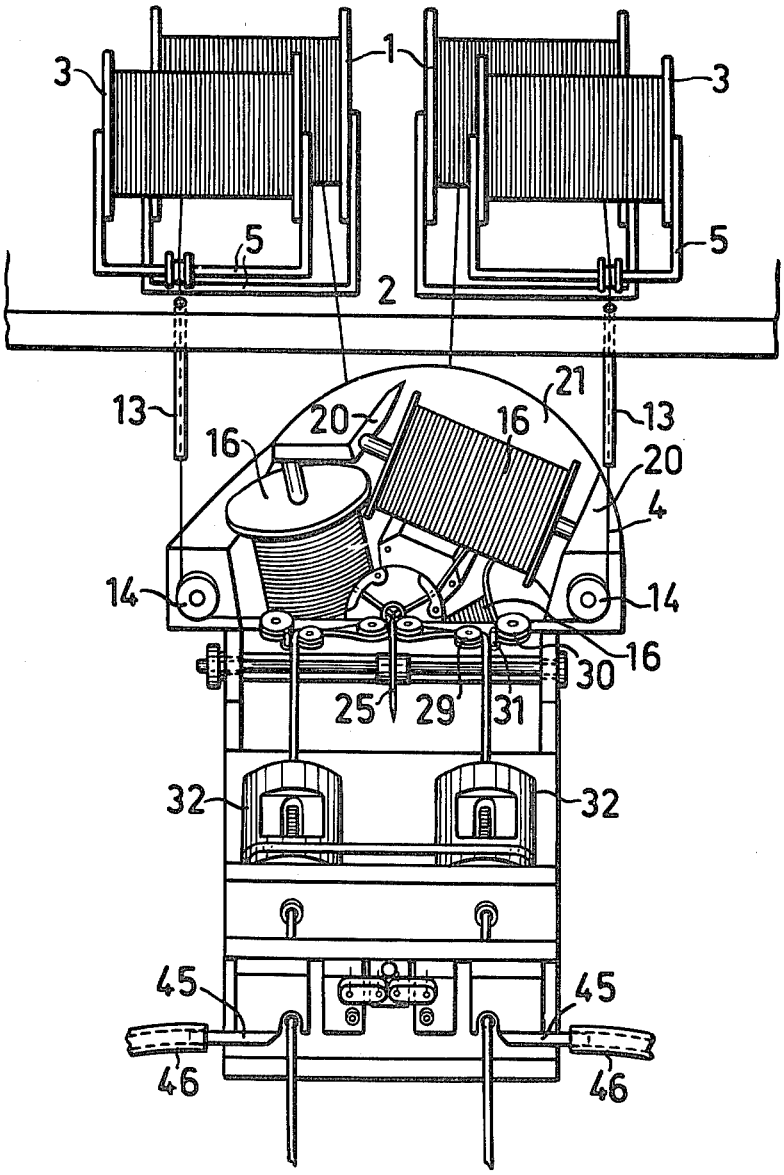
FIG. 3 is a diagrammatic perspective view of the principal parts of the two pipe cleaner forming machines of the pair.

Each machine comprises a first spool 1 for a first rigid (metal) wire 2 and a second spool 3 for a second rigid (metal) wire 4. Each spool is rotatably journaled in a suitable bearing bracket 5 (FIG. 3). The two wires 2, 4 are conducted to a common junction along different paths guided by suitable guides, which are not shown in detail. Thus, the means for guiding the first rigid wire 2 comprise (in addition to further means not illustrated in the drawings) a guide which is generally designated 6 and is of a specific novel design. This wire guide 6 comprises an elongated, flat tounge 7 (see also FIG. 2). The longitudinally extending lateral edges of the tounge 7 are concave, as indicated in FIG. 2. The tounge 7 is enclosed between two side pieces 8 each having a substantially semicircular cross section. That portion of the tounge 7 and side pieces 8 which is located upstream with respect to the path of travel of the first wire 2 is surrounded by or enclosed in an open-ended tube 9 (FIG. 1). The width or diameter of the semicircular side pieces 8 is lightly wider than the largest transverse dimension of the flat tounge 7 which is located symmetrically with respect to the side pieces. On account hereof two channels or tunnels 10 having a substantially square cross section are formed, which are defined by the tounge 7, the side pieces 8 and a ring member 11, which is located downstream of the tube 9 and tightly encloses the tounge 7 and the side pieces 8 for holding them together. Substantially similar tunnels are also formed by the tounge 7, the side pieces 8 and the tube 9. As is apparent from FIG. 1 the downstream end of the tounge 7 projects a considerably distance from the ring 11. The two wires 2 of the respective machines of the pair are conducted through these tunnels.

Figure 4:
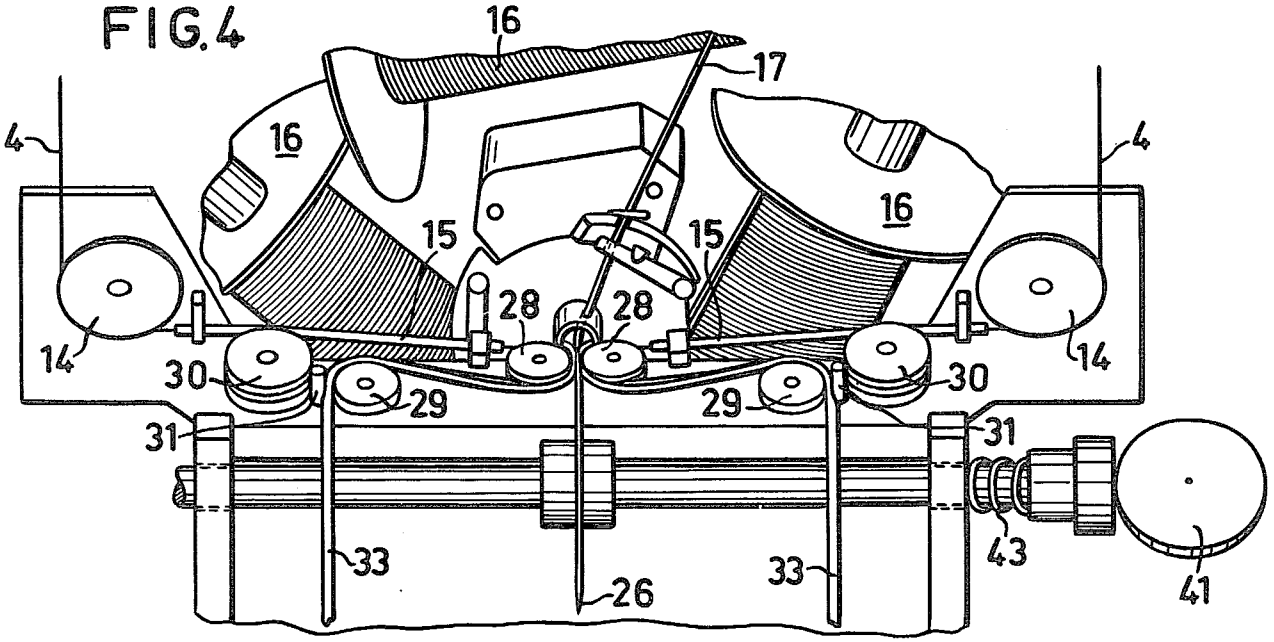
FIG. 4 illustrates, also in perspective the central portion of FIG. 3 on a larger scale.

The means for conducting the second wires 4 from their spools 3 comprise (amoung other things) a first tube 13 (FIG. 3), a first roller 14 and a second tube 15 (FIGS. 1 and 4).

In the preferred embodiment of the invention there are three thread bobbins 16 and three threads 17 for each machine pairs. Each bobbin 16 and thread 17 is provided with a suitable thread tensioning device 18 which is known per se and merely indicated in FIG. 1. The bobbins 16 are rotatably mounted in bearing brackets 20 (FIG. 3) on a disc 21 which may also in its turn be rotatable on an axis which preferably is coaxial with the ring 8 and the tube 9.

The ring 11 is surrounded by a coaxial, open-ended sleeve 22 which is provided with an aperture 23 for each thread 17 and is rotatably journaled in suitable bearings (not shown). If the disc 21 is positively rotated by suitable drive means the sleeve 22 is also positively rotated e.g. by the disc 21 at the rotation of the disc 21. As an alternative the disc 21 may be fixed and the sleeve 22 positively rotated.

This apertured sleeve 21 constitutes a means for winding the threads 17 in oblong loops 24 (FIG. 1) around the two first wires 2 which are advanced through the tunnels 10 and the corresponding tunnels in tube 9. Each wire 2 constitutes a thread loop forming support for the other first wire 2 of the machine pair. On account of the advancement of the wires 2 the threads 17 are wound off their respective bobbins 16 and form helices with oblong or flattened turns during the winding operation.

Downstream of the front end of the tounge 7 the individual thread loops 24 are severed by a rotating circular knife 25 having a circumferential cutting edge 26. Both runs of each loop 24 are severed, so that each loop is divided into two parts or thread pieces.

The point of severance is located downstream of the junction between each first wire 2 and the appurtenant second wire 4. From this junction both wires 2, 4 are advanced jointly under tension close to each other, so that they grip the severed thread pieces between themselves. The common path of the wires 2, 4 extends from their junction around part of the circumference of a rotatable roller 28 which is located adjacent the junction and, in particular, the point of severance, and along part of the circumference of a further roller 29 to a point where one (preferably wire 4) of the wires is diverted from the other wire 2. The branched off wire (which may also be the first wire 2) is conducted around a third roller 30 in the direction shown by the arrow in FIG. 1. A pin or stud 31 cooperates with the second wire 4 to lead it back substantially to the point of separation at an angle of about 50°–70° or possibly 40°–80° with respect to the first wire 2.

Such angle is necessary to enable twisting together of the two wires 2 and 4 for clamping the thread pieces between themselves. This twisting is carried out by means of rotary twisters 32 which rotate the composite wires 2, 4 into helices on their common longitudinal axis and simultaneously advance them in their longitudinal direction.

Figure 5:
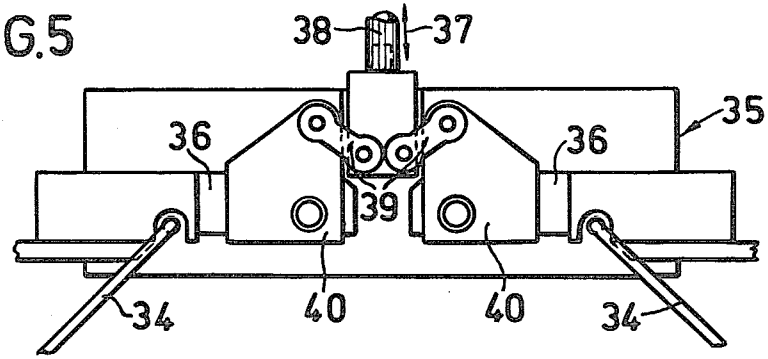
FIG. 5 is a front view of the knife means for cutting the pipe cleaner string into individual pipe cleaners.

The pipe cleaner string 33 thus formed is cut into individual pipe cleaners 34 by means of a cutting device generally designated by 35 in FIGS. 1 and 5. According to FIG. 5 the cutting device 35 comprises two knife blades 36, each belonging to its machine in the pair. The blades 36 are reciprocated vertically, as indicated by the arrow 37 by means of a piston 38 which is common to both blades 36, which are coupled to the piston 38 by links 39 and connecting members 40. Thread filaments are sucked away by suction nozzles 45 connected to hoses 46.

According to a further feature of the invention means are provided for making the pipe cleaners slightly tapered in their overall shape. These means comprise an excentric disc 41 abutting one end of the spindle 42 of the rotary knife 25. This spindle is biased in the right-hand direction in FIG. 1 by a spring 43 (FIG. 4). Thanks to these provisions the knife edge 26 reciprocates cyclically in the axial direction of the knife in the area between the composite wires 2, 4 and 2, 4. One complete cycle of reciprocation corresponds to the total length of two pipe cleaners.

The embodiment described above and shown in the drawings is of course to be regarded merely as a non-limiting example and may as to its details be modified in several ways by omissions and substitutions within the scope of the following claims. In particular, one of the machines of a pair may be omitted. In this case one of the wires 2 has to be replaced by some other thread loop support, and it would be suitable to make the knife 25 severe only one of the two runs of each thread loop to eliminate any waste of thread pieces. Furthermore an ordinary, fixed or reciprocating knife with straight or curved edge may be substituted for the rotary knife 25. The number of threads may also be another than three, e.g. two, four or five. In addition hereto the stud 31 may be located on the other side of the upstream run of the diverted wire (4). The basic principles according to the invention may also be applied to other machines, e.g. for the manufacture of brushes for the cleaning of bottles, different textile, thread and wire articles and so on.

What I claim is:

1. Method of manufacturing pipe cleaners comprising the steps of:

advancing a first, rigid wire along a predetermined path from a first rotatable spool to a first point on said path;

advancing said wire from said first point proximate and parallel to thread loop supporting means to a second point on said path;

feeding at least one soft thread from at least one rotatable bobbin to a third point on said path intermediate said first and second points;

winding said thread around said first wire and said thread loop supporting means between said third and second points;

feeding a second rigid wire from a second rotatable spool substantially into contact with said first wire in a junction near said second point;

successively cutting into pieces the turns of said winding as they approach said second point;

advancing said two wires jointly in close proximate interrelationship while maintaining them tightened for clamping the individual thread pieces between themselves to a fourth point on said path;

diverting one of said wires from the other wire and conducting said diverted wire in a loop to a fifth point, which is proximate to said fourth point where it approaches the other of said two wires at an angle to its longitudinal axis;

twisting said two wires into interlaced helices from said fifth point and onwards for forming a pipe cleaner string in which the individual thread pieces are firmly clamped between said two wires; and cutting said strip into pipe cleaners of predetermined length.

2. Method according to claim 1, wherein said angle between said two wires is about 40°–80°.

3. Method according to claim 1, wherein said thread loop supporting means is a third, rigid, movable wire corresponding to said first wire and comprised in a second pipe cleaner string.

4. Method according to claim 3, wherein the length of said thread pieces is cyclically varied in such a way, that those thread pieces which belong to the first wire become longer when the thread pieces belonging to said third wire become shorter, and conversely.

5. Method according to claim 1, wherein the number of threads is three.

6. Machine for the manufacture of pipe cleaners, comprising means for advancing a first rigid wire through the machine;

means for winding a soft thread around said first wire in loops or turns which are considerably larger than the circumferences of said first wire;

means for severing said thread turns to thereby divide said thread into pieces;

means for advancing a second wire jointly with said first wire through part of the machine;

means for twisting together said wires for clamping said thread pieces between said wires; and means for cutting said two wires twisted together and appurtenant thread pieces into individual pipe cleaners.

7. Machine according to claim 6, wherein said thread winding means comprise thread loop supporting means located proximate and parallel to said first rigid wire upstream of and adjacent to said thread loop severing means, a rotatable thread bobbin, means for unwinding said thread from said thread bobbin while maintaining said thread under tension, and a rotatable means for moving the thread in a path around said first rigid wire and said thread loop supporting means.

8. Machine according to claim 7, further comprising means for moving a third rigid wire in concert with said first rigid wire and wherein said thread loop supporting means comprises said third rigid wire.

9. Machine according to claim 6, characterized by the provision of wire guide means located upstream of said thread severing means and comprising at least one channel portion having a cross sectional area only slightly larger than the cross section of said first wire.

10. Machine according to claim 9, wherein said channel is defined by a substantially flat tounge member, two side pieces, one on each flat side of said tounge member, which project laterally beyond at least one of the lateral, longitudinally extending edges of said tounge member, and a ring member enclosing and holding together said tounge member and said side pieces.

11. Machine according to claim 10, wherein one of said lateral edges of said tounge member is concave in cross section.

12. Machine according to claim 10, wherein said lateral edges of said tounge member are concave in cross section.

13. Machine according to claim 7, wherein said means for unwinding said thread comprise a rotatable, open-ended sleeve which surrounds said first wire and said thread loop supporting means and is provided with an opening for the thread which extends into the sleeve, and means for rotating said sleeve to hereby wind the thread around the first wire and said thread loop supporting means.

14. Machine according to claim 13, wherein said thread winding means comprise a rotatable disc upon which said thread bobbin is mounted in such a way, that the bobbin is movable in a substantially circular path which surrounds said sleeve.

15. Machine according to claim 8, further comprising a second of said machines, wherein said third rigid wire constitutes said first rigid wire of the second of said machines which form a pair together with the firstmentioned machine.

16. Machine according to claim 10, wherein said tounge member projects downstream out of said channel portion and has its outer free end located in close proximity to said thread severing means.

17. Machine according to claim 15, characterized by the provision of wire guide means located upstream of said thread severing means and comprising at least one channel portion having a cross sectional area only slightly larger than the cross section of said first wire and wherein said channel is defined by a substantially flat tounge member, two side pieces, one on each flat side of said tounge member, which project laterally beyond at least one of the lateral, longitudinally extending edges of said tounge member, and a ring member enclosing and holding together said tounge member and said side pieces, and wherein said thread bobbin, said flat tounge member, said side pieces, said ring member, said rotatable sleeve and said thread severing means are common to the two machines of said pair.

18. Machine according to claim 6, characterized by the provision of means for cyclically reciprocating the edge of said thread severing means laterally towards and away from said first wire to hereby vary the length of said thread pieces.

19. Machine according to claim 6, wherein said thread pieces are shorter than the circumferential length of said loops or turns.

* * * * *